US008000635B2

(12) United States Patent
Knapp

(10) Patent No.: US 8,000,635 B2
(45) Date of Patent: Aug. 16, 2011

(54) DEVELOPER HOMOGENIZER FOR MULTI-ENGINE PRINTING SYSTEM

(75) Inventor: John F. Knapp, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 12/339,535

(22) Filed: Dec. 19, 2008

(65) Prior Publication Data

US 2010/0158572 A1 Jun. 24, 2010

(51) Int. Cl.
*G03G 15/08* (2006.01)

(52) U.S. Cl. ..... 399/254

(58) Field of Classification Search ..... 399/254, 399/401

See application file for complete search history.

(56) References Cited

U.S. PATENT DOCUMENTS 4,614,165 A 9/1986 Folkins et al.
5,077,578 A 12/1991 Grammatica et al.
5,436,703 A 7/1995 DeYoung et al.
6,684,045 B2 1/2004 Viturro et al.
7,206,538 B2 4/2007 Kumar et al.
7,366,457 B2 4/2008 Ono
7,418,215 B2 8/2008 Ide
7,418,223 B2 8/2008 Suzuki
2003/0096186 A1 * 5/2003 Viturro et al. ..... 430/117

FOREIGN PATENT DOCUMENTS

JP 2008170510 A * 7/2008

* cited by examiner

*Primary Examiner* — Quana M Grainger
(74) *Attorney, Agent, or Firm* — Fay Sharpe LLP

(57) ABSTRACT

An apparatus and method for homogenizing developer allow variations in image quality between marking engines to be reduced. The apparatus includes a developer homogenizer in communication with the marking engines which receives developer from the first marking engine and developer from the second marking engine and combines them. A first portion of the combined developer is returned to the first marking engine for forming images therewith and a second portion of the combined developer is returned to the second marking engine for forming images therewith.

22 Claims, 8 Drawing Sheets

DEVELOPER HOMOGENIZER FOR MULTI-ENGINE PRINTING SYSTEM

BACKGROUND

The exemplary embodiment relates to printing systems. In particular, it relates to a developer homogenizer which reduces variations between the developer material supplied to different marking engines.

In typical xerographic printing devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developer material. Generally, the developer material, which comprises toner particles adhering triboelectrically to carrier granules, is supplied from a development housing. The latent image attracts the toner particles from the carrier granules to form a toner powder image. The developed image is subsequently transferred to the print medium, such as a sheet of paper. The fusing of the toner image onto paper is generally accomplished by applying heat to the toner with a heated roller and application of pressure.

The carrier granules remain in the development housing while the toner particles are consumed in the forming of images. Fresh toner is generally supplied to the development housing from a replaceable storage bottle. Over time, the carrier granules can age through repeated circulation in the housing. To compensate for this, some development housings progressively discharge a portion of the developer as waste. A small amount of fresh carrier material is incorporated in each fresh toner bottle to compensate for the carrier granules lost in this process.

In multi-engine printing systems, particularly those employing color marking engines, it is desirable for the image quality from each marking engine to be the same, or as close to that of the others as possible. Otherwise, documents which include pages produced by different color marking engines can have noticeable page to page differences. For example, in some applications one marking engine may be used to print side 1 of a duplex sheet and the second marking engine will print side 2. If the output print quality of the first marking engine is different from the second engine, this difference can lead to unacceptable performance. One strategy for mitigating these differences is to monitor the output print quality from each engine with a sensor, such as a full width image bar, compare the two different print quality outputs, and then select the halftone exposure to bring the print quality more in line with each other.

While each marking engine tries to control itself to a common mass developability, in doing so, it can end up working at different image, background, and bias levels, which in turn tends to result in subtle, but other print quality defects. While some image quality consistency problems can be resolved through careful selection of tone reproduction curves, halftone selection, and control of process parameters, differences in image quality may still exist.

There remains a need for improvements in image quality and consistency for multi-engine printing systems.

INCORPORATION BY REFERENCE

The following reference, the disclosure of which is incorporated in its entirety by reference, is mentioned:

U.S. Pat. No. 4,614,165 to Folkins, et al., discloses an apparatus for developing an electrostatic latent image in a printing machine. The apparatus employs a developer material which ages during the life of the printing machine. A continuous supply of fresh carrier granules is supplied to the developer material, which extends its useful life.

BRIEF DESCRIPTION

In accordance with one aspect of the exemplary embodiment, an apparatus for homogenizing developer includes a first marking engine, which uses developer to form images on print media, and a second marking engine, which uses developer to form images on print media. A developer homogenizer is in communication with the first and second marking engines. The developer homogenizer combines developer from the first marking engine and developer from the second marking engine. A first portion of the combined developer is returned to the first marking engine for forming images therewith and a second portion of the combined developer is returned to the second marking engine for forming images therewith.

In accordance with another aspect, a method for homogenizing developer includes combining a first portion of developer from a first marking engine with a second portion of developer from a second marking engine to form a combined developer. A first portion of the combined developer is returned to the first marking engine for forming images therewith and a second portion of the combined developer is returned to the second marking engine for forming images therewith.

In accordance with another aspect, a printing system includes a first marking engine that includes a first development housing which stores developer for forming images on print media. The developer includes toner particles and carrier granules. A second marking engine, spaced from the first marking engine, includes a second development housing which stores developer for forming images on print media. A paper path network is provided, along which printed media from the first and second marking engines is conveyed to a common output destination. A developer homogenizer is in communication with the first and second development housings and receives and combines developer from the first development housing and developer from the second development housing. A conveyor mechanism returns a first portion of the combined developer to the first marking engine for forming images therewith and a second portion of the combined developer to the second marking engine for forming images therewith.

DETAILED DESCRIPTION

Aspects of the exemplary embodiment relate to an apparatus for developer homogenization, to a printing system comprising a developer homogenizer, and to a method of printing with homogenized developer.

It is considered that many of the print quality differences in marking engines stem from differences in the state of the developer materials. Differences may be in be toner concentration, toner charge to mass ratio, developer conductivity, additive level due to toner aging, developer aging, and the like. While it is often possible for each marking engine to control itself to keep solid area mass developability constant, in turn each marking engine will set its electrostatics or toner concentration accordingly, to a different condition depending on the state of the developer materials. This in turn can lead to differences in other print quality attributes, for example, mottle and graininess images that will not be visually equivalent.

The exemplary developer homogenization apparatus homogenizes the developer of two or more marking engines, thereby reducing variations between the developer resident in the two or more marking engines, which can lead to improved image quality and consistency among the marking engines. In particular, a small fraction of developer from a first marking engine can be continuously blended with a small fraction of developer from a second marking engine. Then, this blended developer can be fed back to both marking engines for use in printing. In this way, the developer in each print engine is homogeneous, leading to more consistent print quality.

The term "marking engine" is used herein generally to refer to a device for applying an image to print media. Print media generally refers to a physical sheet of paper, plastic, or other suitable physical print media substrate for images, whether precut or web fed. As used herein, a "printing system" can be a digital copier or printer, bookmaking machine, facsimile machine, multi-function machine, or the like and can include two or more marking engines, as well as other processing components, such as paper feeders, finishers, and the like.

Figure 1:
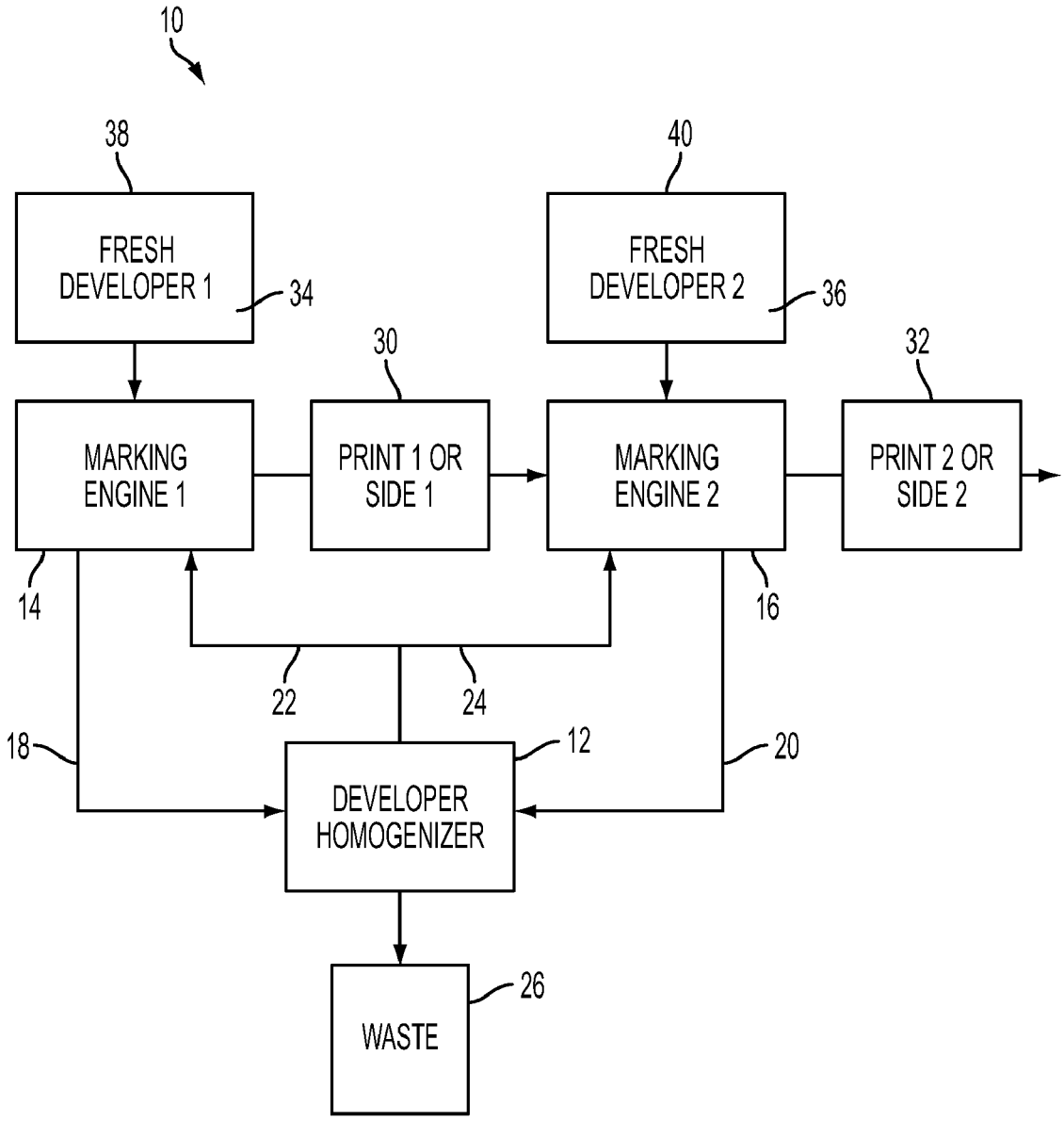
FIG. 1 is a functional block diagram of a developer homogenization apparatus for two marking engines in accordance with one aspect of the exemplary embodiment.

With reference to FIG. 1, an apparatus 10 for homogenizing developer in accordance with the exemplary embodiment is schematically illustrated. The apparatus 10 includes a developer homogenizer 12, which is communicatively linked to first and second xerographic (electrostatic) marking engines 14, 16. It is to be appreciated, however, that the apparatus 10 may include more than two marking engines. While the two marking engines may be nominally identical, each marking engine runs somewhat independently, which can yield slightly different results.

The developer homogenizer 12 receives developer from the first and second marking engines 14, 16 via first and second input pathways 18, 20, respectively. The received developer from the two marking engines 14, 16 is combined and homogenized by the developer homogenizer 12, e.g., by mixing, and first and second portions of the combined developer are returned to respective marking engines 14, 16 via return pathways 22, 24. A small portion of the combined developer may be discarded from the developer homogenizer as waste 26. The pathways 18, 20, 22, 24 may be defined by tubes, conveyor systems, or the like, as described in greater detail below.

The developer is a mixture of colored toner particles (toner) and carrier granules. The toner is consumed by the marking engines 14, 16 during printing. For example, the first marking engine 14 consumes toner in the course of generating a first print on print media 30, while the second marking engine 16 consumes toner in generating a second print on print media 32, which may be the same or a different sheet of print media from print media 30. Each marking engine 14, 16 receives fresh developer 34, 36 from a respective replaceable container 38, 40, although it is also contemplated that the marking engines could be supplied from a common container. The fresh developer is primarily toner particles, optionally with a small amount of carrier granules mixed in, to replace that discarded as waste 26. For example, a small fraction (e.g., about 5%) of fresh carrier is factory blended with raw toner and supplied via the replaceable container 38, 40.

As will be appreciated, in a marking engine which has a plurality of toners of different colors for generating different color separations, such as cyan, magenta, yellow, and optionally black (C, M, Y, and K) toners, a separate developer homogenizer 12 may be provided for each toner color, which communicates with respective development housings in the two marking engines.

Figure 2:
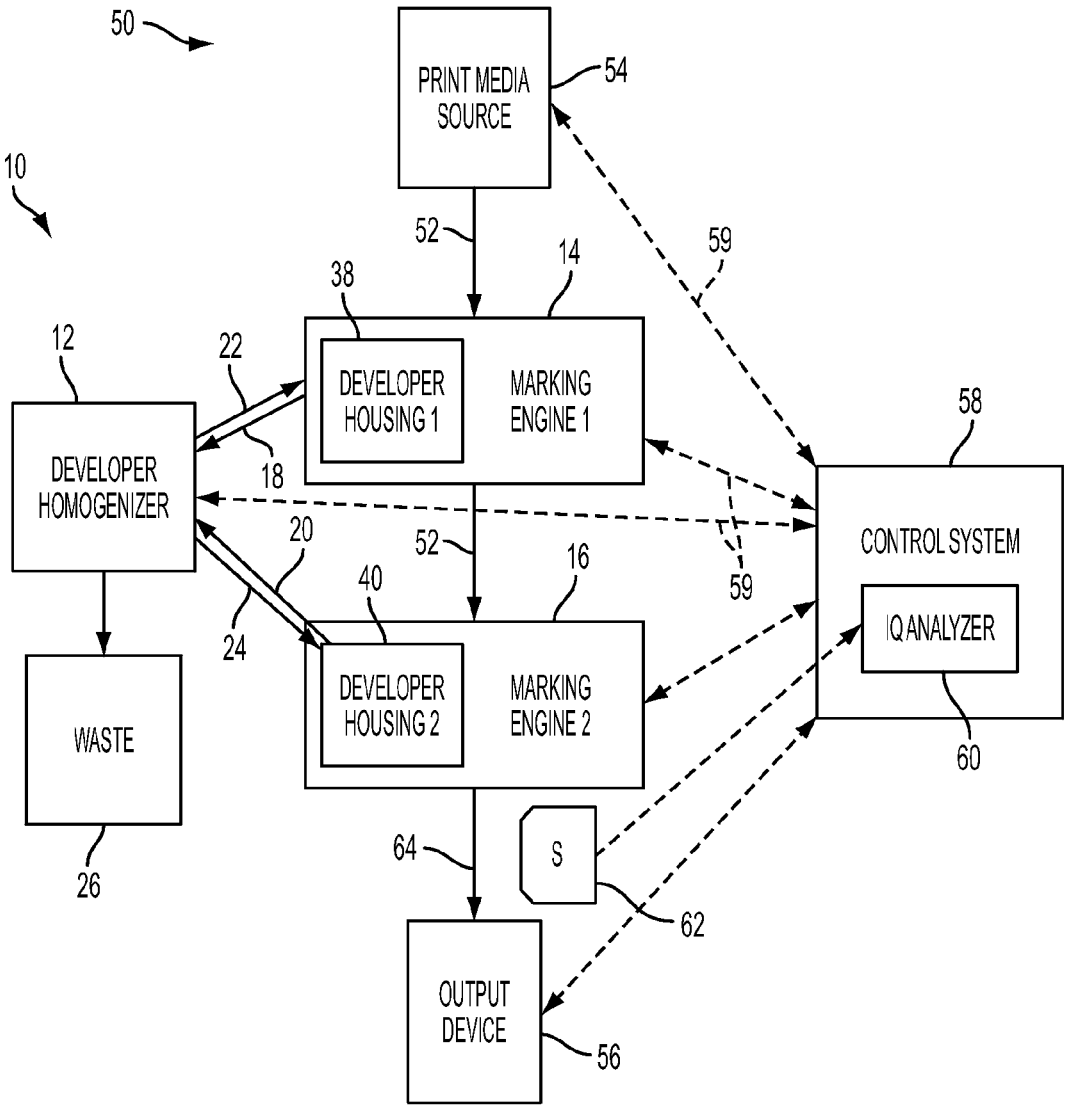
FIG. 2 is a functional block diagram of a first embodiment of a printing system which incorporates the apparatus of claim 1.

FIG. 2 schematically illustrates one embodiment of a printing system 50 which incorporates the exemplary developer homogenization apparatus 10. The printing system 50 includes a network 52 of paper paths. A print media conveyor system (not shown) conveys the print media along the paper paths of the network 52. The conveyor system may include an arrangement of belts, rollers, air jets, or the like. In the illustrated tandem printing system of FIG. 2, the conveyor system conveys print media from a print media source 54, such as a paper feeder, to each of the marking engines 14, 16 in turn. In duplex printing, each of the marking engines 14, 16 applies images to a respective side of the print media. In other embodiments, a bypass pathway may be provided around one or both marking engines whereby sheets are simplex printed on one side only, by a respective one of the marking engines. The conveyor system conveys the printed sheets of print media 30 on paper path network 52 to an output device 56, such as a stacker, stapler, bookbinder, or the like. The components of the printing system 50, including the marking engines 14, 16, conveyor system for paper path network 52, print media source 54, output device 56, and optionally developer homogenizer 12 may all be under the control of a common control system 58, such as a central processing unit (CPU) which may be resident in the printing system's digital front end (DFE). Wired or wireless links 59 (shown by dashed lines) cooperatively couple the control system 58 with the components 12, 14, 16, 54, 56. In one embodiment, the control system 58 controls the developer homogenizer 12 in accordance with the rate of printing. For example, when the printing system 50 is changed from an operational (printing) mode to a sleep mode, the developer homogenizer 12 is stopped until printing recommences. In another embodiment, the control system 58 controls the relative amounts of developer which are conveyed between the marking engines 14, 16 and the developer homogenizer 12, as a function, for example, of the rate of toner consumption, which can be determined in terms of number of copies printed by the respective marking engine, total area coverage of toner, weight of toner consumed, or the like.

Optionally, the printing system 50 includes an image quality (IQ) analyzer 60, which may be incorporated into control system 58 or be in communication with control system 58. The IQ analyzer 60 receives image quality related measurements from a sensor 62, such as a full width array color spectrophotometer. The sensor 62 may be positioned adjacent a portion 64 of the paper path 52 to record color values of the printed media 30 as it passes by. The control system 58 optionally controls the developer homogenization apparatus 10 in accordance with the sensed measurements to reduce variations in the printed outputs of the two marking engines. For example, if the IQ analyzer 60 indicates a difference in image quality between the outputs of the two marking engines 14, 16, the control system 58 may communicate with the developer homogenization apparatus 10 to initiate or accelerate the developer homogenization.

Figure 3:
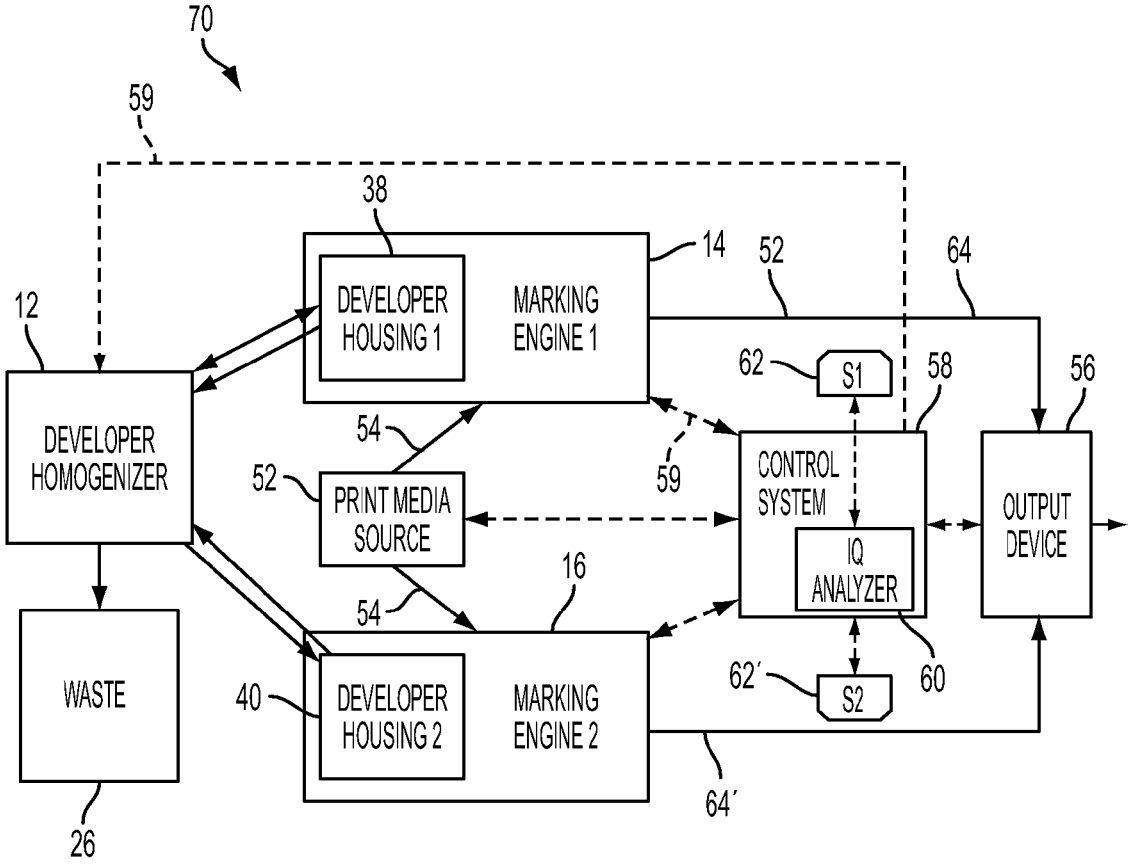
FIG. 3 is a functional block diagram of a second embodiment of a printing system which incorporates the apparatus of claim 1.

In another embodiment of a printing system 70, illustrated in FIG. 3, where similar components are accorded the same numerals, the marking engines 14, 16 may be arranged in parallel. As with the embodiment of FIG. 2, a print media conveyor system conveys print media along a paper path network 52 from one or more print media sources 54 to each of the marking engines 14, 16. In parallel printing, each of the marking engines 14, 16 applies images to a respective sheet 30, 32 of the print media. The conveyor system conveys the printed sheets 30, 32 to an output device 56, where the sheets are merged, e.g., assembled in appropriate order for forming a common document. Once again, the components of the printing system 70, including the marking engines 14, 16, conveyor system for paper path 52, print media source 54, output device 56, and developer homogenizer 12 may all be under the control of a common control system 58. In this embodiment, two sensors 62, 62' are provided, one in each of the output paths 64, 64' of the marking engines 14, 16. However, it is also contemplated that in another embodiment, a single sensor may be positioned in a common pathway which connects both marking engines with the output device 56.

Figure 4:
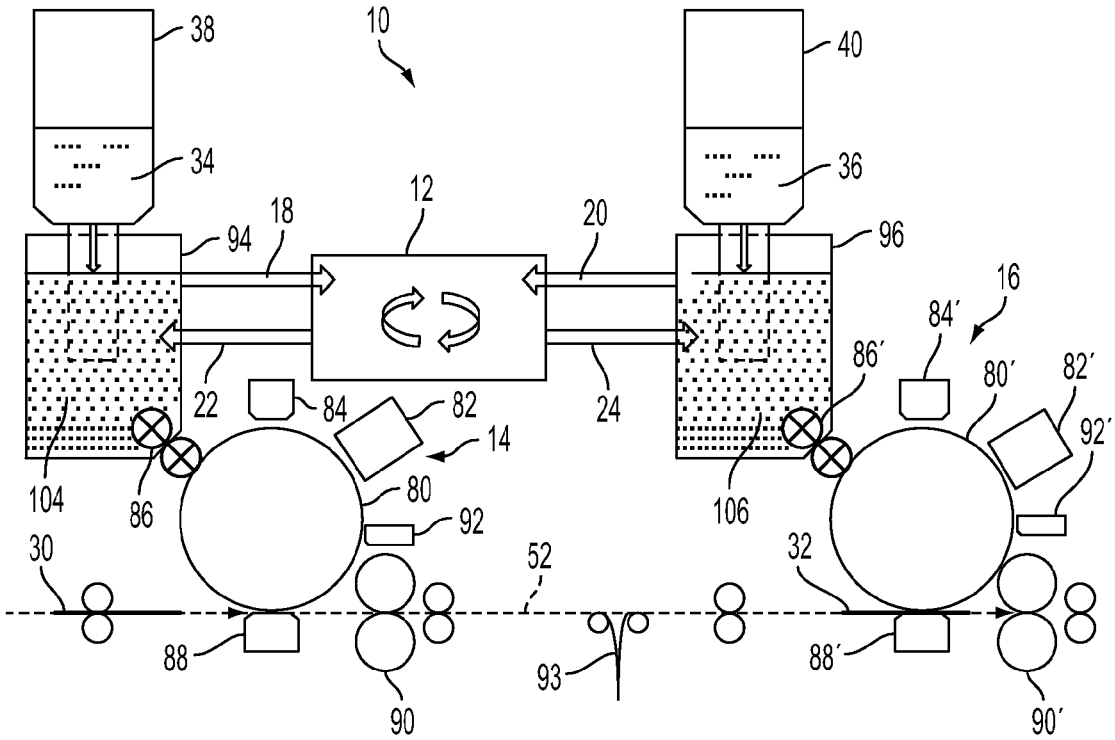
FIG. 4 is a schematic cross sectional view of the marking engines of FIG. 2.

With reference now to FIG. 4, each xerographic marking engine 14, 16 applies toner to print media 30, 32, such as sheets of paper, during the formation of images. The exemplary marking engines 14, 16 may include many of the hardware elements employed in the creation of desired images by electrophotographical (xerographical) processes. For example, the marking engines 14, 16 may utilize two component magnetic brush development systems, either to directly develop electrostatic images on a photoreceptor or to load a donor roll, which in turn is used to develop a photoreceptor. FIG. 4 illustrates an embodiment where images are developed directly on a photoreceptor.

Since both marking engines may be similarly configured, only one marking engine 14 will now be described, with similar elements on the other marking engine indicated by a prime (').

In particular, the marking engine 14 typically includes a charge retentive surface 80, such as a rotating photoreceptor in the form of a belt or drum. The images are created on a surface of the photoreceptor. Disposed at various points around the circumference of the photoreceptor 80 are xerographic components. The xerographic components each perform a portion of a marking operation (the formation of an image on the print media). These components may include a charging station 82 for each of the colors to be applied (one in the case of a monochrome printer, four in the case of a CMYK printer), such as a charging corotron, an exposure station 84, such as a raster output scanner (ROS), which forms a latent image on the photoreceptor, a developer unit 86, associated with each charging station for developing the latent image formed on the surface of the photoreceptor, a transferring unit 88, such as a transfer corotron, a fuser 90, for fusing the toner images to the print media and a cleaning device 92, for cleaning the photoreceptor before a new toner image is formed thereon. As will be appreciated, in a color marking device, there may be multiple charging stations, exposure stations, and associated developer stations arranged around a single photoreceptor, one set for each color. Alternatively, for each toner color, a separate photoreceptor is provided. In this embodiment, the toner images may be transferred from the photoreceptor to the sheet via an intermediate transfer belt. Alternatively, the photoreceptors are arranged in tandem, with the sheets being sequentially marked at a separate transfer station for each of the four colors.

In operation, the photoreceptor 14 rotates and is charged at the charging station 82. The charged surface arrives at the exposure station 84, where a latent image is formed. The portion of the photoreceptor on which the latent image is formed arrives at the developer unit 86, which applies toner to the latent image to obtain a toner image. The developed image moves with the photoreceptor to the transferring unit 88, which transfers the toner image thus formed to the surface of the print media substrate 30 (or to an intermediate transfer belt), by applying a potential to the sheet. The sheet and image are conveyed away from the photoreceptor to the fuser 90, which fuses the toner image to the sheet using heat and/or pressure. Meanwhile, the photoreceptor 14 rotates to the cleaning device 92, which removes residual toner and charge from the photoreceptor, ready for beginning the process again. It is to be appreciated that the marking engine 14, 16 can include an input/output interface, a memory, a marking cartridge platform, a marking driver, a function switch, a controller and a self-diagnostic unit, all of which can be interconnected by a data/control bus.

An inverter 93 may be positioned in the paper path 52 between the two marking engines 14, 16 for inverting each sheet that has been marked on a first side by the first marking engine 14 prior to marking it on the second side by the second marking engine 16 (for duplex printing).

During use, each marking engine 14, 16 consumes fresh toner. A replaceable toner bottle 38, 40 is configured for interconnection with each developer unit 86 for replenishing the developer unit with fresh developer 34, 36. Each developer unit 86 includes a development housing 94, 96 which stores a supply of the developer. The toner rich blend can be fed into the development housing through a conventional toner dispenser. As fresh carrier is continually supplied through the toner dispenser, the developer volume in the development housing 94, 96 expands.

Figure 5:
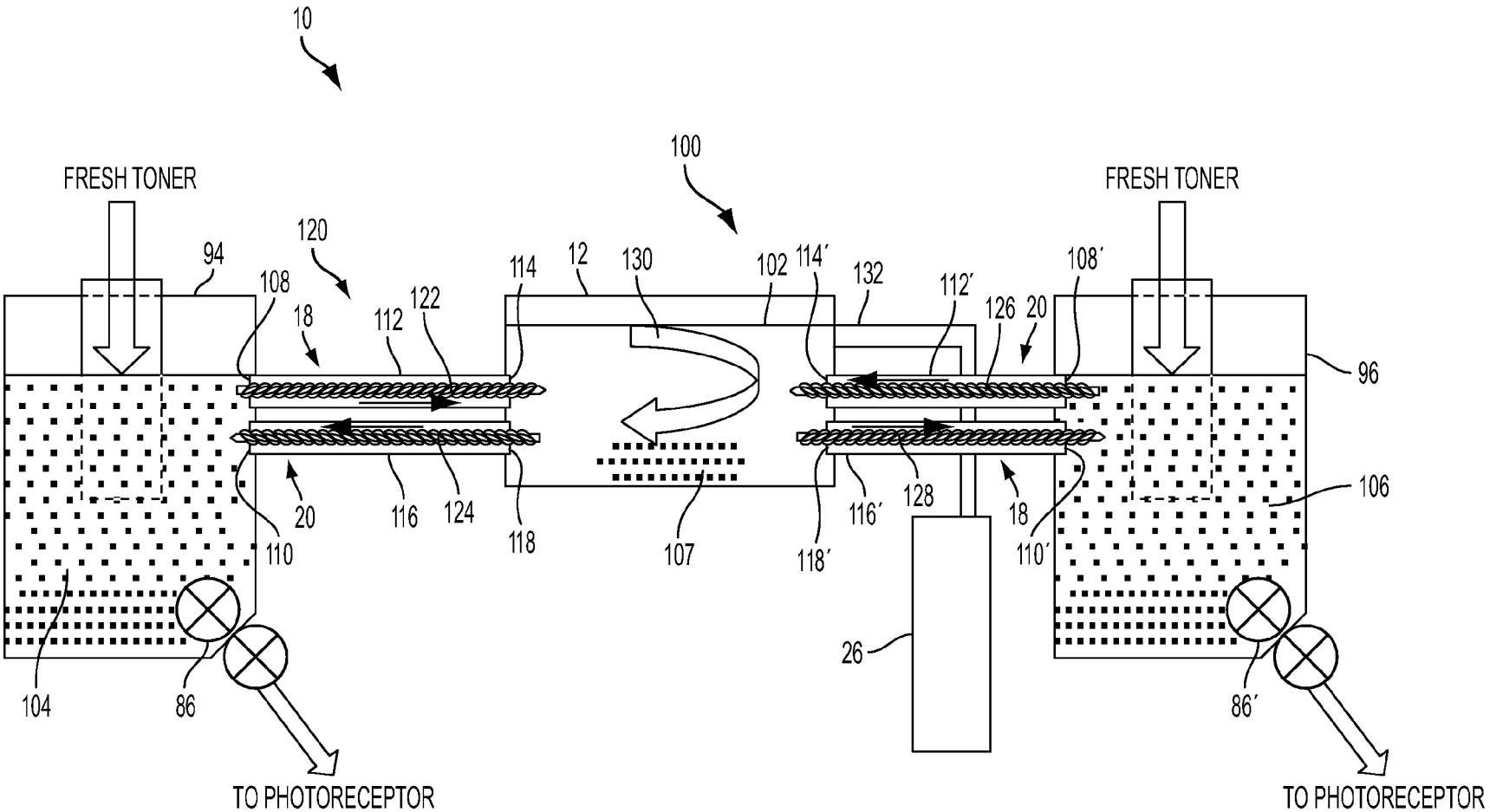
FIG. 5 is a schematic cross sectional view of a first embodiment of a developer homogenization apparatus which homogenizes developer from development housings of first and second marking engines.

One embodiment of a homogenization apparatus is shown in FIG. 5. Each development housing 94, 96 is in communication with the developer homogenizer 12 via input pathways 18, 20, on which developer is conveyed between the respective development housing and homogenizer 12. The exemplary developer homogenizer 12 includes a homogenizer housing 100 which defines an interior chamber 102 in which developer 104 from the first development housing 94 is brought into contact with developer 106 from the second development housing 96 to form a combined developer 107. In the exemplary embodiment, each development housing 94, 96 includes a respective outlet port 108, 108' and an inlet port 110, 110', e.g., in a side wall of the respective housing 94, 96. The outlet pathways 18, 20 are each defined by a respective tube 112, 112' which connects the outlet port 108, 108' with a respective inlet 114, 114' to the chamber 102. Similarly, return pathways 22, 24 are each defined by a respective tube 116, 116' which connects the inlet port 110, 110' with a respective outlet 118, 118' to the chamber 102. The expansion of the developer volume in the housing allows developer to exit the development housing through the outlet port 108, 108.

A conveying mechanism 120 conveys the developer between the development housings 94, 96 and the homogenizer 12. The exemplary conveying mechanism 120 includes a set of augers 122, 124, 126, 128, one arranged in each of the tubes 112, 112', 116, 116', which transports developer in the direction indicated by the accompanying pathway direction arrow. In this way, augers 122, 126 carry developer to the chamber 102 and augers 124, 128 carry mixed developer back to the development housings 94, 96. Optionally, a mixing device 130, within the chamber 102, assists in mixing the developer from the two sources. The mixing device 130 may be a simple twin auger mixer, such as found in conventional development housings for mixing and blending toner and carrier. In this way, the developer homogenizer 12 blends the developer from the first marking engine thoroughly with the developer from the second marking engine, so as to reduce or eliminate any bi-modal toner mass, toner charge, and developer conductivity differences, and the like. This blended developer can then be split and returned to each marking engine, thus allowing each marking engine to run with identical develop state settings, thereby improving print quality consistency. A waste line 132 carries a small portion (e.g., about 5%) of the combined developer from an overflow port in the homogenizer housing to a replaceable waste container 26.

One or more of the rate of rotation of the augers 122, 124, 126, 128, and the speed of mixing of the mixing device 130 may be under the control of the control system 58, allowing variable mixing rates and/or ratios of mixing of the two developers. The augers each are connected by a drive shaft to a drive member such as motor (not shown), which causes the augers to rotate in the direction shown. As will be appreciated, by appropriate gear selection, two or more of the augers may be driven by a common motor.

Figure 6:
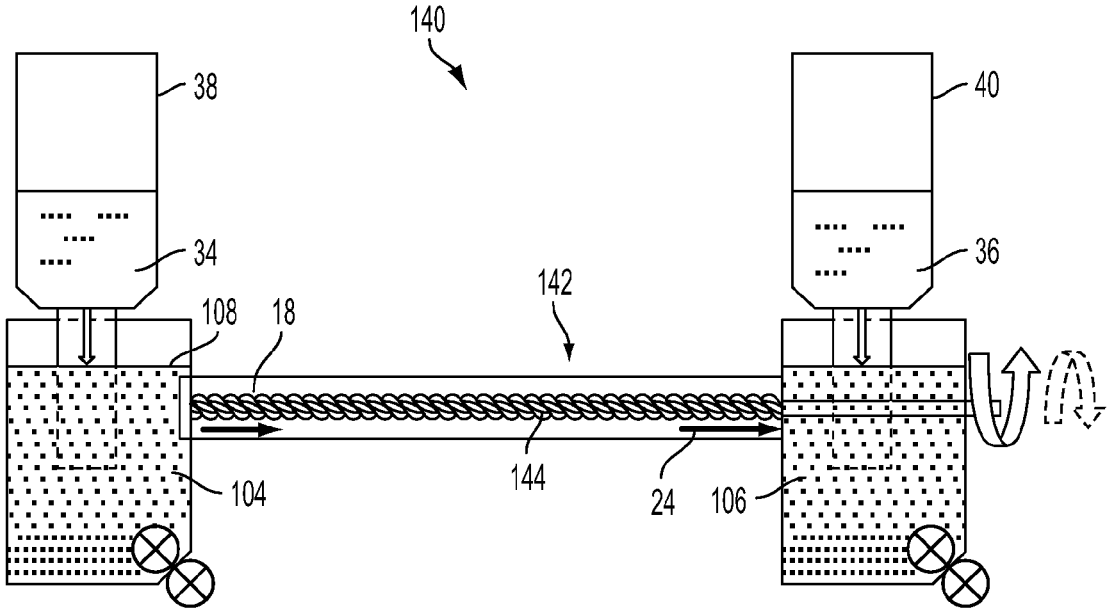
FIG. 6 is a schematic cross sectional view of a second embodiment of a developer homogenization apparatus which homogenizes developer from development housings of first and second marking engines.

With reference to FIG. 6, an alternative developer homogenization apparatus 140 which may be utilized in the printing systems of FIGS. 2 and 3 is shown. Homogenization apparatus 140 acts to homogenize the two developers, as for homogenizer 10, but achieves the homogenization in a somewhat different way. In this embodiment, pathways 18, 20, 22, 24 are selectively defined by a single tube 142, which connects with respective ports 108, 108' of the development housings 94, 96 which serve as both input and output ports. The conveying mechanism may include an auger 144, which is disposed with the tube 142. The direction in which the developer is conveyed is periodically varied by varying the direction of rotation of the auger 144. In this way, for a first period of time, developer is transported from housing 94 to housing 96, and thereafter, developer is transported for a second period from housing 96 to housing 94. In this embodiment, a single, two directional motor may be employed for driving the drive shaft of the auger in two opposed directions (clockwise and anti-clockwise).

Figure 7:
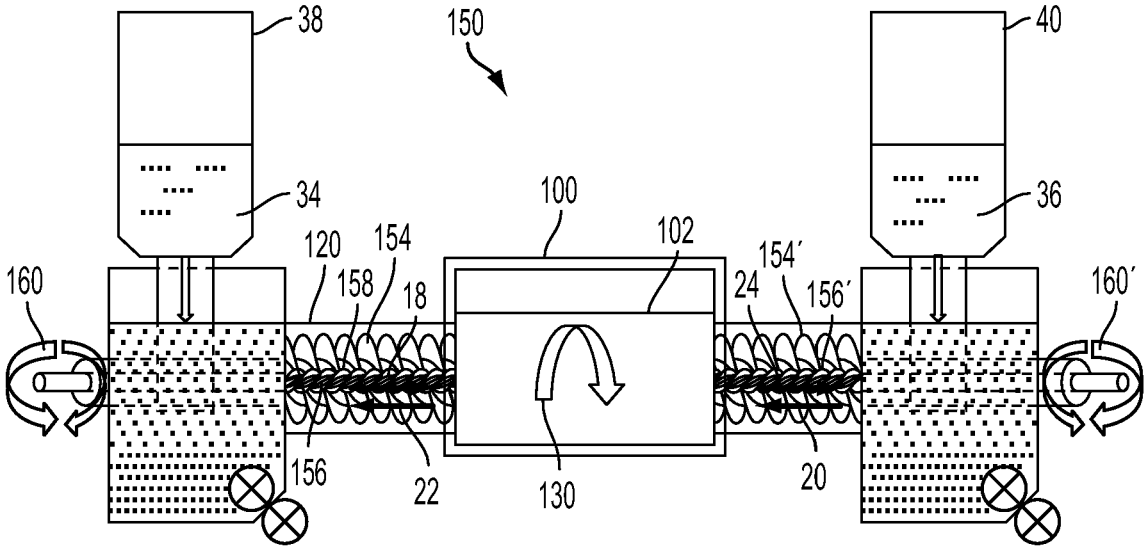
FIG. 7 is a schematic cross sectional view of a third embodiment of a developer homogenization apparatus which homogenizes developer from development housings of first and second marking engines.

With reference to FIG. 7, an alternative developer homogenizer 150, which may be utilized in the printing systems of FIGS. 2 and 3, is shown. In this embodiment, the conveying mechanism 120 includes two augers 154, 156 which are concentrically arranged such that developer can travel in both directions at the same time. The inner auger 154 may be spaced from the outer, hollow auger 156 by a tube 158. Each of the augers may be connected via a respective drive shaft to a motor 160. While the twin augers may extend from one development housing to the other, in the embodiment shown, a second pair of twin augers 154', 156' and a motor 160' are provided. There is thus one twin auger for each development housing 94, 96, which connects the respective development housing with a homogenizer housing 100 as previously described.

Figure 8:
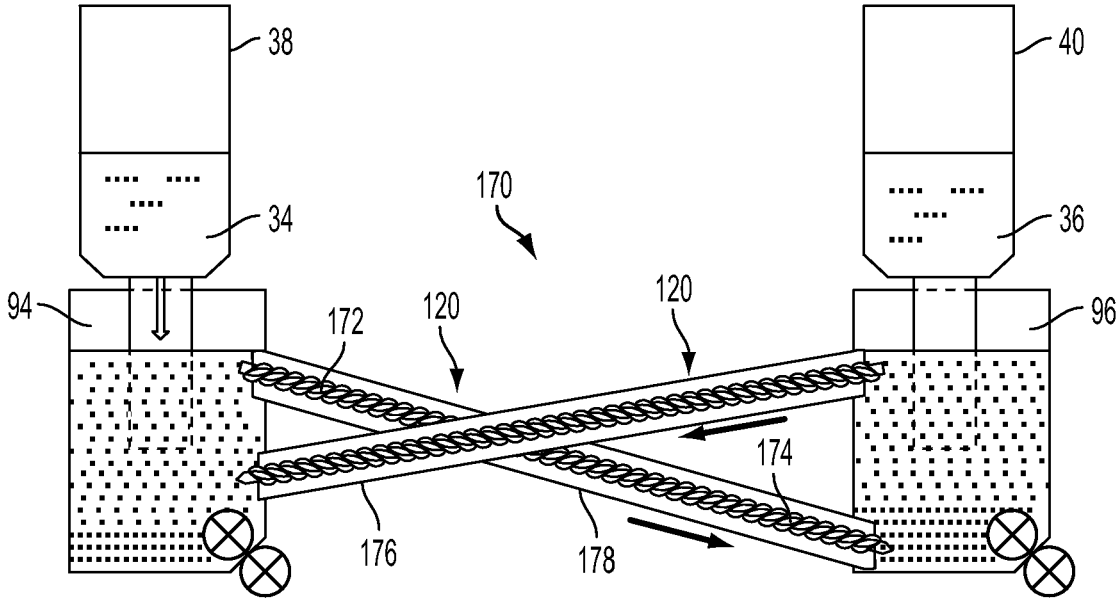
FIG. 8 is a schematic cross sectional view of a fourth embodiment of a developer homogenization apparatus which homogenizes developer from development housings of first and second marking engines.

With reference to FIG. 8, an alternative developer homogenizer 170, which may be utilized in the printing systems of FIGS. 2 and 3, is shown. In this embodiment, the conveying mechanism 120 includes two augers 172, 174 which are arranged in respective downwardly angled tubes 176, 178 such that developer motion is aided by gravity.

In other embodiments, rather than using augers, the conveying mechanism may employ gravity flow. For example, the outlet port of each development housing may be positioned such that excess developer in the development housing trickles out of the port and is carried by gravity to an inlet of the homogenizer housing. The developer homogenizer may use augers to return the homogenized developer to the development housings or raise the homogenized developer to sufficient height that a gravity feed system is able to return the homogenized developer to the development housings.

While FIGS. 4-8 show the marking engines arranged serially, it is to be appreciated that the marking engines may be arranged in parallel.

The embodiments of the developer homogenization apparatus 10 disclosed herein are suitable for performing the exemplary method of homogenizing toner, in which toner from development housings of respective marking engines is combined and returned thereto, thereby reducing differences in at east one material property of the developers in the respective housings, such as toner charge to mass ratio, toner concentration, developer conductivity, and the like.

An exemplary printing method which may be performed with the embodiments disclosed herein includes combining a first portion of developer 104 from a first marking engine 14 with a second portion of developer 106 from a second marking engine 16 to form a combined developer 107. A first portion of the combined developer 107 is returned to the first marking engine for forming images therewith and a second portion of the combined developer returned to the second marking engine for forming images therewith. The combining may include mixing the first and second portions of developer. The combining may include conveying the first portion of developer from a development housing 94 of the first marking engine via a first pathway 18 to a chamber 102 and conveying the second portion of developer from a development housing 96 of the second marking engine via a second pathway 20 to the chamber. The method may further include outputting a portion of the combined developer 107 as waste.

The developer homogenization apparatus finds application in a variety of printing systems which employ multiple marking engines although it is also contemplated that the apparatus may be employed for homogenizing toner from otherwise entirely separate printing systems. Some advantages of the homogenization apparatus are that the mixing and blending of developer achieved by the apparatus are able to eliminate or at least substantially reduce print quality variations from each engine that result from developer material state differences in each engine. These differences could be toner concentration, toner charge to mass ratio, the age of the developer, the developer conductivity, and variations in toner aging due to potential different toner throughput rate in each individual marking engine. While the exemplary homogenization apparatus may not entirely eliminate the need for other controls it can supplement and improve their performance.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An apparatus for homogenizing developer comprising:

a first marking engine which uses developer to form images on print media;

a second marking engine which uses developer to form images on print media; and a developer homogenizer, in communication with the first and second marking engines, combines developer from the first marking engine and developer from the second marking engine, a first portion of the combined developer being returned to the first marking engine for forming images therewith and a second portion of the combined developer being returned to the second marking engine for forming images therewith.

2. The apparatus of claim 1, further comprising a conveyor mechanism which conveys the developer between the first and second marking engines and the developer homogenizer and combined developer between the developer homogenizer and the first and second marking engines.

3. The apparatus of claim 2, wherein the conveyor mechanism comprises at least one of a gravity feed system and at least one auger.

4. The apparatus of claim 1, wherein each of the marking engines comprises a development housing which stores developer, each development housing having an outlet port in communication with the development homogenizer via a respective outlet pathway.

5. The apparatus of claim 4, wherein each of the development housings has an inlet port in communication with the development homogenizer via a respective inlet pathway.

6. The apparatus of claim 1, wherein the developer received from each marking engine comprises a mixture of toner particles and carrier granules.

7. The apparatus of claim 1, wherein the developer homogenizer outputs a portion of the combined developer as waste.

8. The apparatus of claim 7, wherein each marking engine is fed with fresh developer from a respective container of fresh developer, the fresh developer comprising toner particles and carrier granules.

9. The apparatus of claim 1, wherein toner particles in the developer received from the first marking engine are of the same color as toner particles in the developer received from the second marking engine.

10. The apparatus of claim 1, wherein the developer homogenizer comprises a mixing device for mixing developer from the first and second marking engines.

11. The apparatus of claim 10, wherein the mixing device comprises at least one auger.

12. The apparatus of claim 1, wherein the developer homogenizer comprises a chamber in which developer from the first and second marking engines is combined.

13. A printing system comprising the apparatus of claim 1.

14. The printing system of claim 13, further comprising an image quality analyzer which analyses the image quality of images output by the first and second marking devices, and a control system which controls the apparatus based on the analysis of the image quality to reduce a variation between the output images of the first and second marking engines.

15. The printing system of claim 13, further comprising a paper path network which conveys print media between the first and second marking engines.

16. The printing system of claim 13, further comprising an output device which receives printed media from the first and second marking engines.

17. A method for developer homogenization comprising:

combining a first portion of developer from a first marking engine with a second portion of developer from a second marking engine to form a combined developer;

returning a first portion of the combined developer to the first marking engine for forming images therewith; and returning a second portion of the combined developer to the second marking engine for forming images therewith.

18. The method of claim 17, further comprising outputting a portion of the combined developer as waste.

19. The method of claim 17, wherein the combining comprises mixing the first and second portions of developer.

20. The method of claim 17, wherein the combining comprises conveying the first portion of developer from a development housing of the first marking engine via a first pathway to a chamber and conveying the second portion of developer from a development housing of the second marking engine via a second pathway to the chamber.

21. A printing system comprising:

a first marking engine comprising a first development housing which stores developer for forming images on print media, the developer comprising toner particles and carrier granules;

a second marking engine, spaced from the first marking engine, comprising a second development housing which stores developer for forming images on print media, the developer comprising toner particles and carrier granules;

a paper path network along which printed media from the first and second marking engines is conveyed to a common output destination;

a developer homogenizer in communication with the first and second development housings which receives and combines developer from the first development housing and developer from the second development housing; and a conveyor mechanism which returns a first portion of the combined developer to the first marking engine for forming images therewith and a second portion of the combined developer to the second marking engine for forming images therewith.

22. The printing system of claim 21, wherein each marking engine comprises at least an additional development housing containing developer with toner particles of a different color from the toner particles in the first and second development housings, the system further comprising at least an additional developer homogenizer in communication with the additional development housings of the first and second marking engines for combining developer of the respective toner color.

* * * * *